United States Patent [19]

Chesnut et al.

[11] Patent Number: 4,769,938

[45] Date of Patent: Sep. 13, 1988

[54] COMPOSITE BARREL CONSTRUCTION MADE USING INJECTION MOLDING

[75] Inventors: M. Gaines Chesnut, Kremmling; Thomas L. Castetter, Elizabeth, both of Colo.

[73] Assignee: Ram-Line, Inc., Golden, Colo.

[21] Appl. No.: 69,993

[22] Filed: Jul. 6, 1987

Related U.S. Application Data

[62] Division of Ser. No. 909,772, Sep. 19, 1986, abandoned.

[51] Int. Cl.[4] ..... F41C 21/02

[52] U.S. Cl. ..... 42/76.02; 42/75.01; 42/101

[58] Field of Search ..... 42/76.01, 76.02

[56] References Cited

U.S. PATENT DOCUMENTS

| | | | |
|---|---|---|---|
| 2,845,741 | 8/1958 | Day | 42/76.02 |
| 2,847,786 | 8/1958 | Hartley et al. | 42/76.02 |
| 3,118,243 | 1/1964 | Manshel | 42/76.02 |
| 3,228,298 | 1/1966 | Grandy et al. | 42/78 |
| 3,299,558 | 1/1967 | Karl | 42/76.02 |
| 3,517,585 | 6/1970 | Slade | 42/76.02 |

*Primary Examiner*—Deborah L. Kyle
*Assistant Examiner*—Michael J. Carone
*Attorney, Agent, or Firm*—Sheridan, Ross & McIntosh

[57] ABSTRACT

A number of rifle parts are provided to improve the appearance, facilitate the assembly/disassembly, and/or ease the carrying of a conventional rifle. In a preferred application one or more of the rifle parts are used with a 22 caliber rifle. The rifle parts include a handle unit that can be added to the conventional rifle and which is separate and detachable from the rifle body. The handle unit can be connected to the rifle body using fasteners or a dovetail arrangement. The handle unit preferably includes aligning holes through which the shooter can see the original rifle sight at the free end of the rifle barrel. A front sight assembly is provided in which a front sight is elevated to be in alignment with the rear sight. The front sight assembly makes use of the original sight or the sight slot to maintain the proper sight line between the rear sight and the front sight. A barrel retaining assembly is also provided which can be substituted for the conventional barrel retaining device. The retention assembly includes a wedge movable relative to a support block for use in engaging/disengaging a rifle barrel notch. A lighter rifle barrel construction is also provided. The rifle barrel includes a metal barrel end member for connection to the rifle body, a metal insert member press fitted to the barrel end member, and a casing that surrounds the insert member. Preferably, the casing is made of a plastic-like material and the plastic is located about the insert member by injection molding.

4 Claims, 5 Drawing Sheets

COMPOSITE BARREL CONSTRUCTION MADE USING INJECTION MOLDING

This is a division of application Ser. No. 909,772, filed Sept. 19, 1986, now abandoned.

FIELD OF THE INVENTION

The present invention relates to the incorporation of one or more of various rifle parts in a rifle and, in one embodiment, to modifying a caliber 22 rifle using one or more kit parts to facilitate carrying and disassembly of the rifle.

BACKGROUND OF THE INVENTION

Many rifles are available without carrying handles. For example, the Ruger 10/22 caliber rifle is a well-known and widely used firearm. This rifle normally includes a separate and detachable mounting plate located adjacent to the chamber of the rifle. A scope is mounted to the rifle using the mounting plate. Unlike other known weapons, such as the AR15/M16 rifle, the typical 22 rifle is not made with a carrying handle. In known rifles with handles, the handle is integral with, and not separate from, the remaining portions of the rifle and the scope is mounted to the top portion of the handle. If a handle having a rear sight is incorporated on the 22 rifle when a scope is not utilized, it is necessary to also elevate the front sight of the rifle so that front and rear sights are aligned. That is, if a handle is added, the scope mounting point is thereby raised in order to provide a handle space. Because of this elevation, the fixed rear sight is elevated and, to maintain the desired sight line, the front sight must also be elevated. In the known type of rifle with the integral handle, only one sight and sight slot are utilized and the sight is elevated using clamping pieces located relatively adjacent to the rifle chamber.

The Ruger 10/22 rifle includes a barrel which can be detached in a shop with appropriate tools. The detachable barrel has a reduced diameter end which fits within a sleeve in the rifle chamber. The 10/22 rifle also typically includes a retaining device attached adjacent to the sleeve and having a wedge or projection which engages a notch in the barrel to prevent withdrawal of the barrel from the sleeve. The wedge has a width substantially conforming to the width of the notch that it engages. The usual retaining device includes a block having a channeled top portion on which a portion of the barrel having the reduced end is seated. The block is fastened to the rifle with a pair of bolts extending through bores in the block. The bores align with threaded holes located adjacent to the chamber of the rifle. The barrel cannot be removed from the sleeve unless the bolts securing the block to the rifle are unscrewed from the threaded holes so that the wedge is disengaged from the barrel notch. The process of installing or removing the block thus requires the shooter to use a hexagonal wrench to screw or unscrew each bolt. Furthermore, when the block is installed on the rifle, care must be taken to align the block fastening bolts with the threaded holes in the rifle. Consequently, the installation and removal of the retaining device requires considerable time and requires the use of a tool.

In another known rifle, a detachable barrel is also incorporated. The connection/disconnection of this rifle barrel is accomplished using a threaded connector that surrounds an end portion of the barrel. This threaded connector is used to engage threads formed on the rifle near the rifle chamber.

The typical 10/22 caliber rifle also has a barrel made of only a metal material, such as steel. The all-metal barrel adds to the weight of the rifle. In one known rifle, the barrel is comprised of two different materials. An inner metal sleeve extending throughout the length of the barrel is entirely surrounded by an aluminum casting, which helps to reduce the weight of the barrel. This composite material barrel is formed by a casting process, however, and the finished product only includes the inner metal sleeve and the outer aluminum material located about the metal sleeve.

SUMMARY OF THE INVENTION

In accordance with the present invention, a number of rifle parts that can be included in a kit have been devised to facilitate the carrying and quick field disassembly of a rifle. In a preferred embodiment, the kit is used with a 22 caliber rifle and, more particularly, the Ruger 10/22 rifle. The kit of the present invention includes a handle unit for mounting a scope and for providing a handle to carry the rifle. The handle unit is detachable and separate from the rifle and, preferably, includes aligning holes through which the shooter can see the original sight. In one embodiment, the handle unit is connected to the rifle using fasteners. In another embodiment, which can be provided in the same handle unit, the connection is made using a dovetail configuration. In either embodiment when a scope is not utilized, the shooter can use the aligning holes and original sight to accurately aim the rifle.

The kit also includes an elevated front sight assembly having a sight element and which is located at the free end of the barrel so that the shooter is able to aim the rifle using the sight element when the scope mounting point is elevated by the addition of the handle unit. In a first embodiment, the front sight assembly is aligned with the barrel using the original sight of the rifle. In a second embodiment, the front sight assembly is aligned, using a double dovetail, with the slot or space formerly occupied by the original sight after it is removed from the rifle barrel. In either of these two embodiments the scope is not utilized.

The kit further includes a barrel retention assembly which permits relatively rapid connection/disconnection of the rifle barrel from the rifle body. The barrel retention assembly replaces the normal retaining device found on the 10/22 rifle. The barrel of the 10/22 rifle typically includes a reduced diameter end portion which seats within a mating sleeve adjacent to the rifle chamber. Additionally, the barrel typically is provided with a notch near the reduced diameter end portion. The barrel retention assembly includes a support block with a channeled upper surface conforming to the curvature of the rifle barrel and an extendable notch engaging member or wedge movable relative to the support block. A slot is formed in the channelled upper surface. The wedge has, preferably, a self-holding taper and moves relative to the slot using a knob and screw shaft or by means of a toggle assembly. When the wedge engages the barrel notch it is at an angle of about 45° or less relative to the rifle barrel to best secure the connection. Further, because the wedge is self-holding in the slot when the engagement is made between the wedge and rifle barrel, unwanted rotation of the barrel relative to the channelled upper surface is essentially eliminated. In one embodiment the notch is sized and shaped as a female member for receiving portions of the tapering wedge. Once the notch is engaged, the barrel is fixedly held in the rifle sleeve. The notch engaging member acts to hold the line of sight equal to the original sight line that existed prior to the substitution of the barrel retention assembly for the normal retaining device found on the 22 caliber rifle. Preferably also, the support block includes ridges extending from the plane of the channelled upper surface, which ridges cooperate with bosses formed on the rifle barrel to facilitate alignment and securement of the barrel to the rifle body.

A further change to a conventional rifle contemplated by the present invention is a novel barrel construction characterized by a lighter outer material which surrounds a heavier and strong metal material. This barrel construction includes a metal barrel end member and an elongated metal insert member press fitted to the barrel end member. The insert member has a substantially greater length than the length of the barrel end member. A much lighter material, such as plastic, is formed or located about the insert member, preferably by injection molding. The insert member preferably includes serrations to ensure securement of the plastic to the barrel end member. The barrel end member is connected to the rifle body and acts to absorb substantially all of the explosive force that results when a cartridge is fired from the rifle through the rifle barrel.

In view of the foregoing summary, a number of important advantages of the present invention are readily seen. A handle for comfortably carrying a rifle normally made without a rifle handle is provided without the loss of the ability to mount a scope to the rifle. The novel handle can be used with or without a scope mounted to it. When a scope is not being utilized, to maintain the necessary sighting, a front sight assembly is fixedly attached to the free end of the rifle barrel and different embodiments are provided wherein the necessary alignment is maintained in order to achieve accurate sighting. A barrel retention assembly allows for easy and quick removal and/or connection of the rifle barrel using a movable wedge without loss of the line of sight. A rifle barrel construction is also provided that reduces the weight of the barrel and also the cost of the rifle barrel. Although each of the rifle parts can be provided in a single kit, each can be provided separately, including being a part of the original manufactured rifle.

Additional advantages of the present invention will become readily apparent from the following discussion, when taken in conjunction with the accompanying drawings.

DETAILED DESCRIPTION OF SPECIFIC EMBODIMENTS

Figure 1:
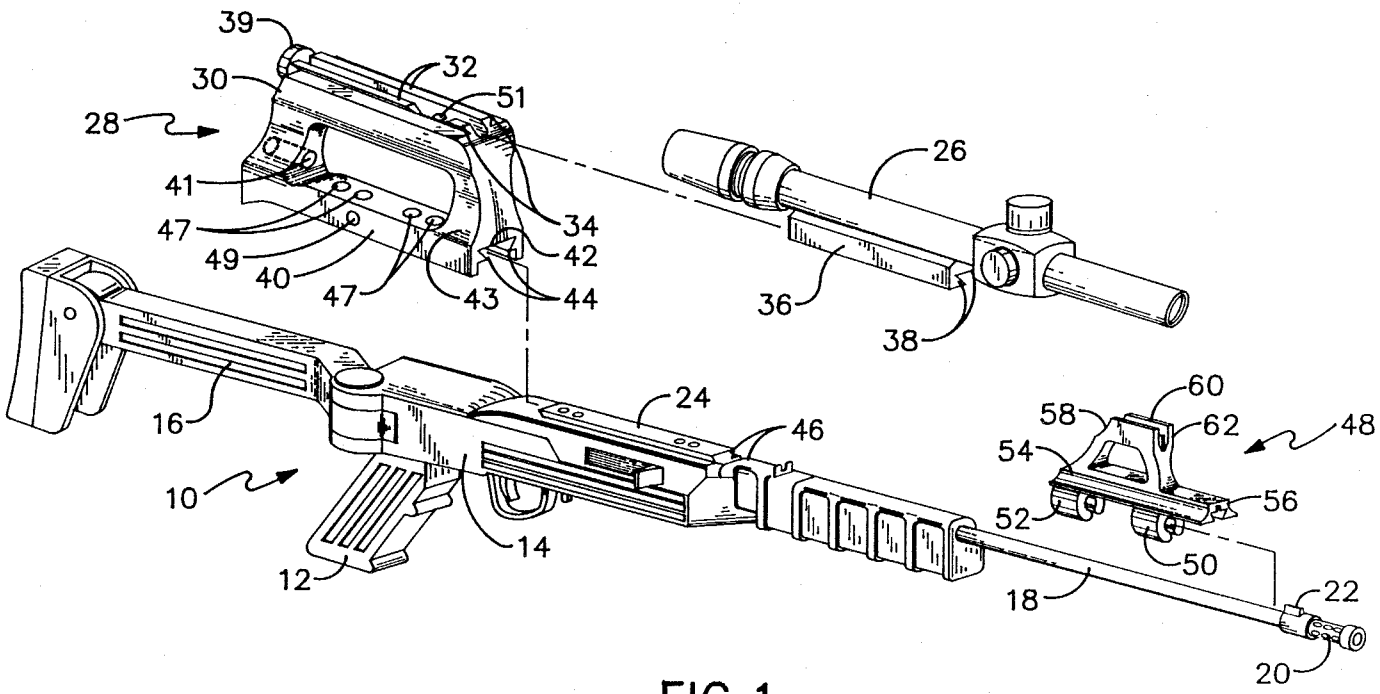
FIG. 1 is a perspective, exploded view of a 22 caliber rifle illustrating a detachable handle unit and a front sight assembly of the present invention.

With reference to FIG. 1, a rifle 10 is illustrated, together with rifle parts that are included in the kit of the present invention. The illustrated rifle 10 is a 22 caliber rifle, namely a Ruger 10/22, although other rifle models could be utilized with rifle parts of the present invention. The illustrated parts are used to modify the conventional rifle 10. A gripping handle 12 is located adjacent to a chamber 14 of the rifle 10. In the embodiment shown, a folding stock 16 is connected to the end of the rifle 10 near the gripping handle 12. The rifle 10 also includes a barrel 18 having a muzzle 20 positioned at its free end. Adjacent to the muzzle 20 is a conventional sight 22, which is used by the shooter in aiming the rifle 10. The conventional rifle 10 also comes with a dovetail scope mounting plate 24, which is attached by screws or the like to the rifle chamber 14. Before the parts of the present invention, the mounting plate 24 was used to directly connect a scope 26 to the rifle 10.

Figure 2:
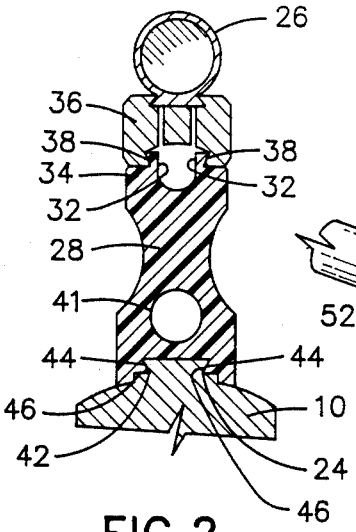
FIG. 2 is a vertical cross-sectional view of the handle unit with the scope mounted thereto.

With regard to certain of the parts themselves, they include a handle unit 28 that is used both as a handle for the shooter to carry the modified rifle and an elevated support for the scope 26. The handle unit 28 includes a handle 30 defined along the upper portion of the handle unit 28 and which has a pair of rails 32 extending longitudinally along the top surface of the handle 30. To attach the scope 26 to the handle unit 28, the rails 32 have outwardly angled longitudinal sides 34 which are insertable in a slotted member 36, attached to the scope 26. The slotted member 36 has correspondingly inwardly angled longitudinal sides 38 so as to create a dovetail arrangement with the rails 32, as best seen in FIG. 2, in order to connect the scope 26 to the upper portion of the handle unit 28. An adjustable or movable rear sight 39 is located at an end of the handle unit 28 and is used in sighting when the scope 26 is not utilized. The handle unit 28 also has a lower portion 40. Formed between the upper and lower portions in the handle unit 28 are a pair of aligning holes 41, 43, as best seen in FIG. 1. The aligning holes 41, 43 can be used by the shooter, together with the original sight 22, in aiming at a desired target, in a case in which the scope 26 is not utilized.

The lower portion 40 of the handle unit 28 has a slot 42 with inwardly angled longitudinal sides 44. The slot 42 is adapted to receive the mounting plate 24 of the rifle 10 along its outwardly angled longitudinal sides 46. The mounting plate 24 and the slot 42 together form a dovetail arrangement for insuring that the handle unit 28 is firmly secured to the rifle 10. As also can be seen in FIG. 1, the handle unit 28 includes a number of fastener or screw holes 47 formed through parts of the lower portion 40. The fastener holes 47 permit the handle unit 28 to be connected to a rifle by means ither than the dovetail arrangement. Instead of the handle unit 28 being connected to the mounting plate 24, the mounting plate 24 is not present or is removed and fasteners through the holes 47 are used to connect the handle unit 28 to the rifle. Preferably, in the case in which the handle unit 28 is attached to the rifle using fasteners through the holes 47, such fastener holes 47 align with already formed holes in the rifle to which the handle unit 28 is to be mounted. Corresponding and aligned holes 51, one which is shown in FIG. 1, are formed in the upper portion of the handle unit 28 so that a suitable tool can readily access the fasteners for use in connecting/disconnecting the handle unit 28 to the rifle. Preferably also, the lower portion 40 includes at least one opening 49 formed in a lateral direction for receiving a set screw to better connect the handle unit 28 to the mounting plate 24, when the bottom portion dovetail configuration is utilized. Although the embodiment shown in FIG. 1 illustrates a handle unit having both fastener holes and a dovetail configuration, it should be appreciated that each of these two differnet connecting means could be provided in separate handle units. It is preferable, however, to incorporate both in a single handle unit in order to give the user flexibility in the use of the handle unit 28.

Figure 3:
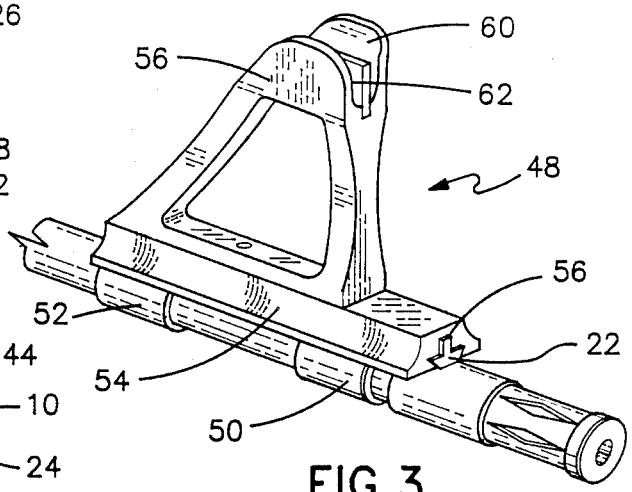
FIG. 3 is an enlarged perspective view of the front sight assembly illustrated in FIG. 1 showing the connection thereof to the original sight of the rifle.

The rifle parts of the present invention further include a front sight assembly 48, which is best seen in FIG. 3 where it is attached to the free end of the barrel 18. The front sight assembly 48 provides an elevated sight that aligns with the rear sight 39, when it is mounted to the handle unit 28. In the embodiment shown in FIGS. 1 and 3, the front sight assembly 48 includes a pair of slightly resilient jaws 50, 52 for positioning about the barrel 18 to securely fasten the assembly 48 to the barrel 18. The jaws 50, 52 are integral with a body 54 of the sight assembly 48. A slot 56 is formed in the underside of the body 54 for mating with the original sight 22 of the conventional rifle 10. The sight assembly 48 also includes a pair of guards 58, 60 extending upwardly to define a space therebetween. A front sight or sight element 62 is, preferably, an integrally formed part of the assembly 48 and is positioned between the two guards 58, 60. In the preferred embodiment, the sight element 62 is an integral, molded part of the front sight assembly 48. The guards 58, 60 are used to protect against damage to the sight element 62, for example, when the modified rifle is dropped by the shooter. When the original sight 22 is received by the slot 56 of the front sight assembly 48, the sight element 62 and the original sight 22 are in the same vertical plane so that sight alignment accuracy is maintained using the elevated sight element 62. That is, in this embodiment, the front sight assembly 48 relies on the original sight 22 itself to achieve an accurate position of the sight element 62, namely, by the mating engagement between the slot 56 and the original sight 22.

Figure 5:
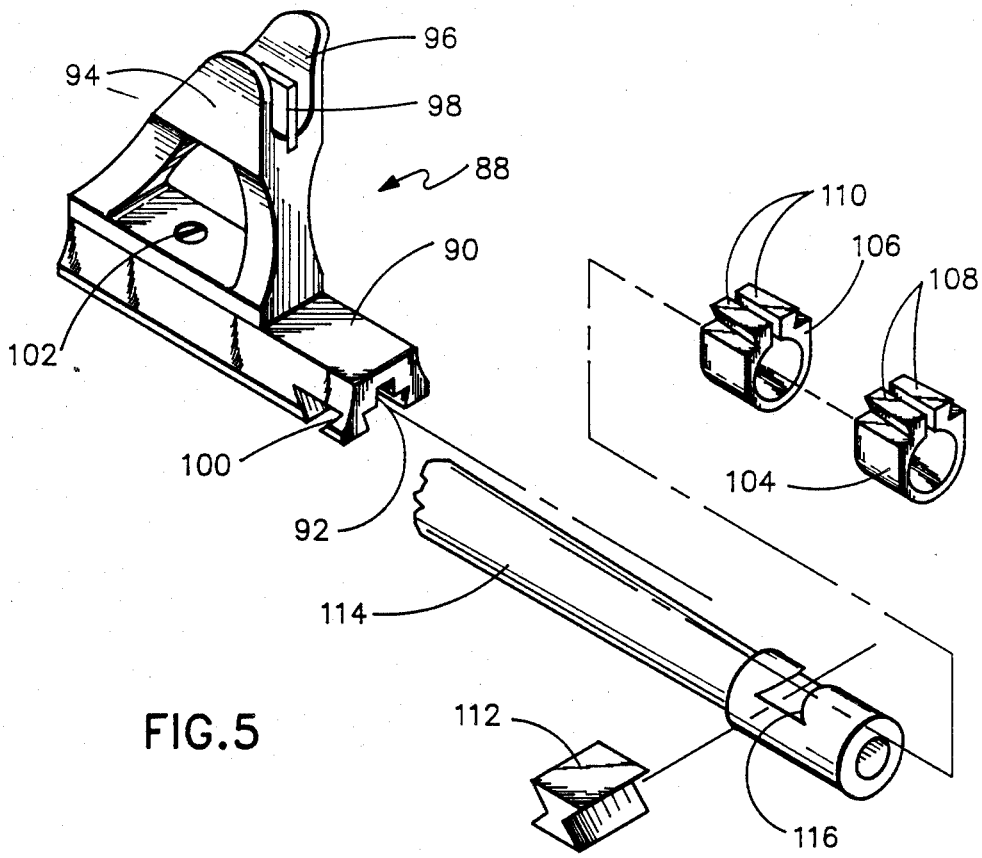
FIG. 5 is an exploded, perspective view of another embodiment of a front sight assembly in which the original sight is removed.

With reference to FIG. 5, another embodiment of a front sight assembly is illustrated. As seen in FIG. 5, this front sight assembly 88 includes a body 90 having a longitudinally extending slot 92 formed in the lower portion of the body 90. Also like the embodiment of FIGS. 1 and 3, the front sight assembly 88 includes a pair of guards 94, 96 with a sight element 98 located between the two guards 94, 96. Unlike the embodiment of FIGS. 1 and 3, a dovetail lateral slot 100 is formed in the lower portion of the body 90 and extends laterally through a section of the lower portion. As also seen in FIG. 5, a retaining screw 102 is located vertically through the center of the body 90 for use in enhancing the connection of the front sight assembly 18 to a rifle barrel. The front sight assembly 88 also includes a pair of barrel gripping members 104, 106. The barrel gripping member 104 includes a pair of adjacent, but separated, tapering portions 108. Similarly, the barrel gripping member 106 includes a pair of adjacent, but separate, tapering portions 110. This embodiment of a front sight assembly is also characterized by an insert or plug 112 which, together with the barrel gripping members 104, 106, act to hold the front sight assembly 88 to a barrel 114 in a fixed position adjacent to its free end. In particular, the barrel 114 includes a sight slot 116 from which the conventional or original sight, if present, is removed.

In securing the front sight assembly 88 to the rifle barrel 114 at its free end, each of the two barrel gripping members 104, 106 is positioned about the barrel 114, with the barrel gripping member 104 located relatively more adjacent to the barrel free end. Because the rifle barrel 114 is tapered towards its free end, the opening or bore through the barrel gripping member 104 is of a size that provides a secure connection of the gripping member 104 to the barrel near its free end. After the two barrel gripping members 104, 106 are positioned on the barrel 114, the front sight assembly 88 is positioned over the barrel 114 for engaging each of the two barrel gripping members 104, 106. The dovetail arrangement of the slot 92 mates with each of the two barrel gripping members 104, 106. After the front sight assembly 88 is in its desired position, the user then slides or moves the barrel gripping member 106 in a rearward direction away from the free end of the barrel 114 until the size of the opening or bore in the barrel gripping member 106 corresponds to the diameter of the barrel 114 whereby a tight or secure fit is provided between the barrel gripping member 106 and the barrel 114. As can be appreciated, the diameter of the opening or bore of the barrel gripping member 106 is greater than that of barrel gripping member 104 because of the tapering of the barrel 114. To complete the assembly, the insert 112 is positioned in both the lateral slot 100 and the sight slot 116. It should also be understood that appropriate tools or devices can be employed in providing the connection of the various parts of the embodiment of FIG. 5. It should also be appreciated that other methods and constructions of barrel gripping members can be employed for providing the desired functions that are achieved by the embodiment of FIG. 5.

As can be understood from the description of the two embodiments of a front sight assembly, this part of the invention is characterized by the use of either the original sight or the slot occupied by the original sight in providing the proper sight line for the elevated sight element. It should also be appreciated that it is not necessary to utilize the barrel gripping members 104, 106 with only the alignment construction illustrated in FIG. 5. Rather, such barrel gripping members could be substituted for the resilient jaws 50, 52 shown in the embodiment of FIGS. 1 and 3. Similarly, the jaw configuration could be substituted for the barrel gripping members of FIG. 5.

Figure 4:
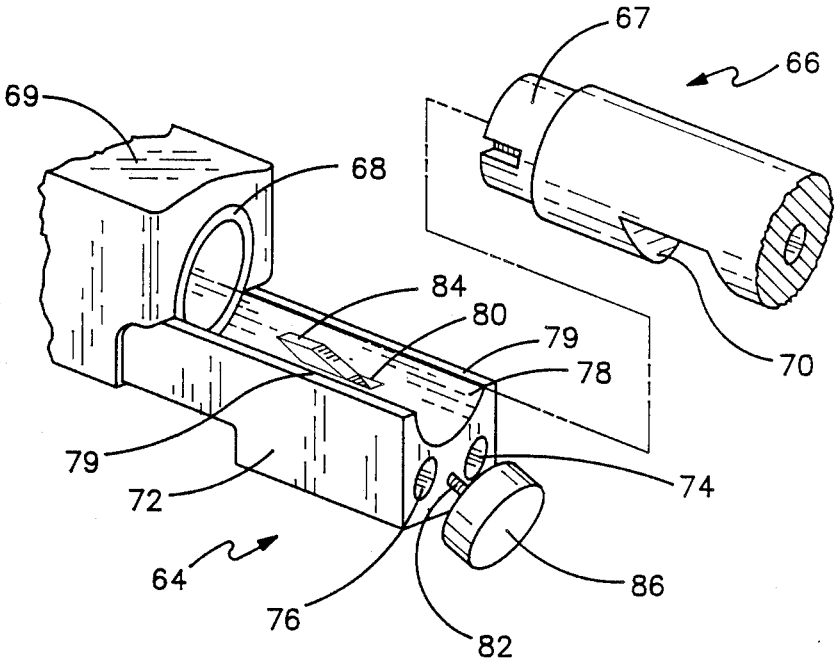
FIG. 4 is an enlarged, pictorial view of a portion of the rifle of FIG. 1 illustrating a barrel retention assembly of the present invention.

Another rifle part of the present invention that can be used in modifying a conventional rifle is the barrel retention assembly 64 shown in FIG. 4. Basically, the barrel retention assembly 64 enables the shooter to make a relatively rapid connection/disconnection of the barrel 18 from the body of the rifle 10. With reference to FIG. 4, the rifle barrel includes a section 66 with a reduced diameter end 67, which can be received by a sleeve 68 formed in the rifle body 69. The section 66 also has a notch 70 formed therein for use in connecting the barrel to the rifle body 69. Although the barrel retention assembly 64 can be included in the same kit as the handle unit 28 and/or the front sight assembly 48 or 88, it also could be provided separately.

The barrel retention assembly 64 includes a support or retaining block 72 which is connected to the rifle using conventional bolts received through holes 74, 76 formed in the block 72. The block 72 also has a channelled upper surface 78 for supporting the underside of the barrel 18. The block 72 also has ridges 79 formed at the edges of the upper surface 78. The vertically-extending ridges 79 improve the barrel-receiving capability of the block 72 and the channelled upper surface 78. A bore is formed at an angle through the support block 72 and terminates in a slot 80 in the upper surface 78. A threaded shaft 82 is positioned in the bore 80 and has a wedge or notch engaging member 84 joined to one end thereof. At the opposite end of the shaft 82, a hand knob 86 is connected to the shaft 82 to enable the user to extend and retract the wedge 84. That is, as the hand knob 86 is rotated, the wedge 84 does not rotate but moves inwardly or outwardly relative to the support block 72 whereby the wedge 84 can be positioned flush with the surface 78 or, alternatively, at an outward position relative to the surface 78, as illustrated in FIG. 4.

In the conventional retaining device typically found in the Ruger 10/22, the wedge does not move relative to the retaining element or block. The wedge of the conventional retaining device is much wider than that shown in FIG. 4 and the user must unfasten bolts located in the block in order to disengage the relatively wide wedge from the notch formed in the rifle barrel. This process of disassembly usually takes a considerable amount of time. By substituting the barrel retention assembly of the present invention for the conventional retaining device, considerable time is saved in the assembly/disassembly of the rifle barrel to the body of the rifle. For example, to disconnect the rifle barrel from the rifle body, the user merely grasps the hand knob 86 and rotates the same to move the wedge 84 out of engagement of the notch 70 of the barrel section 66. There is no need to disconnect or loosen fasteners held in a support block using a hex wrench or other appropriate tool.

Figure 7:
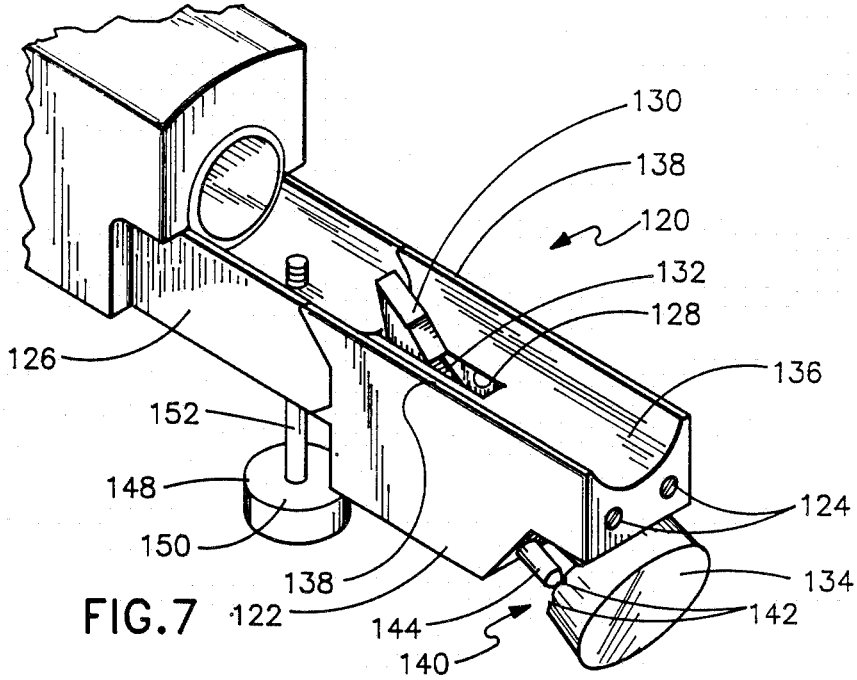
FIG. 7 is a perspective view of another embodiment of a retention assembly showing a locking construction for preventing rotation of the rotatable hand knob.
Figure 8:
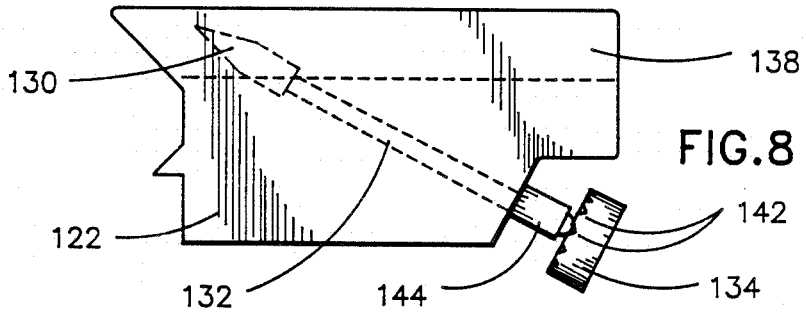
FIG. 8 is a diagrammatic side view of the retention assembly of FIG. 7 further illustrating the locking construction.

Another embodiment of a barrel retention assembly is illustrated in FIGS. 7 and 8. In this embodiment, a retention assembly 120 is illustrated and includes a support block 122 having holes for receiving bolts 124, which are used to connect the support block 122 to a receiver 126 of the rifle. Like the embodiment of FIG. 5, a bore is formed at an angle through the support block 122 and terminates in a slot 128. A wedge or notch engaging member 130 is non-rotatably held at the end of a shaft 132 which is positioned in the bore 128. The wedge 130 is preferably formed with a self-holding taper whereby, when the upper part of the wedge 130 engages the rifle barrel notch, a mid portion of the wedoe 130 is fixedly held in the slot 128 to prevent possible rotation of the barrel. A hand knob 134 is connected to the opposite end of the shaft 132. A channelled upper surface 136 is formed in the support block having ridges 138 extending upwardly along the edges of the channel 136. Unlike the embodiment of FIG. 4, the retention assembly 120 includes a locking assembly 140. The locking assembly 140 includes small notches or recesses 142 formed in a surface of the hand knob 134. The locking assembly 140 also includes a post 144 connected to the support block 122 and extending towards the hand knob 134. When the wedge 130 properly engages the notch of the rifle barrel, one of the notches 142 receives the tip of the post 144 to prevent unwanted rotational movement of the hand knob 132 and, as a result, prevent the disengagement of the wedge 130 from the rifle barrel notch. The cooperation between a notch 142 and the tip of the post 144 is illustrated in FIG. 8. In another variation of this embodiment, a separate holding member is provided and is attached to the conventional rifle barrel notch. The holding member is a female member and is sized and shaped to receive portions of the wedge for use in providing even better engagement between the rifle barrel and the wedge. The embodiment of FIG. 7 also shows the use of a retaining screw 148 having a relatively large head 150 and a shaft portion 152. The retaining screw 148 is used to connect the rifle stock to the receiver 126 and the large head 150 enables the user to connect/disconnect the rifle stock without a tool.

Figure 9:
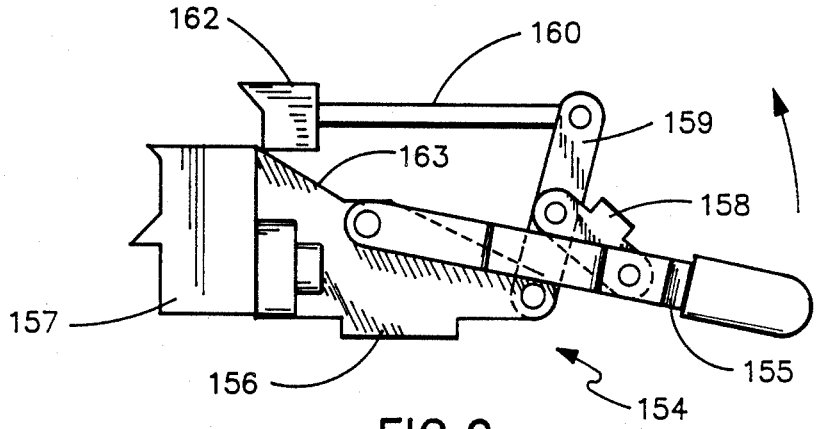
FIG. 9 is a diagrammatic side view of still another embodiment of the retention assembly in which a toggle assembly is employed to move the wedge relative to the support block.

Various mechanisms can be employed to move the wedge relative to the support block. A further particular type of mechanism is illustrated in FIG. 9 and includes a toggle assembly 154 which includes a handle 155. The handle 155 is pivotally connected to a connector piece 156 that is used in connecting the toggle assembly 154 to a support block 157. The toggle assembly 154 also includes a locking member 158 that is connected to a linking member 159. The linking member 159 is attached to a shaft 160. The opposite end of the shaft 160 is connected to a wedge block 162. When it is desired to connect the rifle barrel to the rifle body, the handle 155 is pivoted in a counterclockwise direction, with reference to FIG. 9, whereby the wedge block 162 moves along an angled portion 163 of the connector piece 156 and then comes into engagement with the rifle barrel notch by means of the pivotal connections of the locking member 158 and the linking member 159. With the wedge block 162 engaging the rifle barrel notch, the upper portion of the locking member 158 engages the linking member 159 whereby the locking member 158 resists any force tending to cause a disengagement between the wedge block 162 and the rifle barrel notch. To disengage the wedge block 162 from the rifle barrel notch, the handle 155 is moved in a clockwise direction whereby the wedge block 162 moves in a generally downward direction along the angled portion 163.

Figure 6:
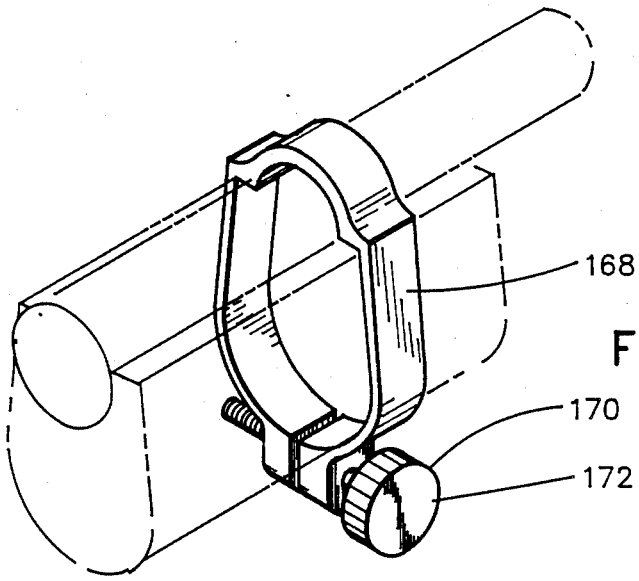
FIG. 6 is a perspective view of a clamping device in which the connecting bolt has an enlarged head.

A further part that can be substituted for a conventional rifle part is shown in FIG. 6. In a conventional 22 caliber rifle, to remove the rifle stock from the rifle it is necessary to utilize a screwdriver in order to unfasten a screw that holds a clamp for connecting the stock to the rifle. This can be inconvenient and unnecessarily time-consuming when it is desirable to remove the rifle stock. The kit of the present invention solves this problem in a manner similar to that utilized in the barrel retention assembly. As shown in FIG. 6, a clamping device 168, that is adapted to surround a portion of a rifle barrel and the rifle stock, is tightened using a fastener 170 having a relatively large head 172. Unlike the conventional parts that require a screwdriver or like tool, the user is able to grasp the head 172 for tightening and untightening the clamping device 168 so that, when it is desired to remove the rifle stock from the rifle, the fastener 170 can be loosened by rotating the large head 172 using the fingers of the user's hand. Consequently, no additional tool needs to be carried or used by the shooter.

Figure 10:
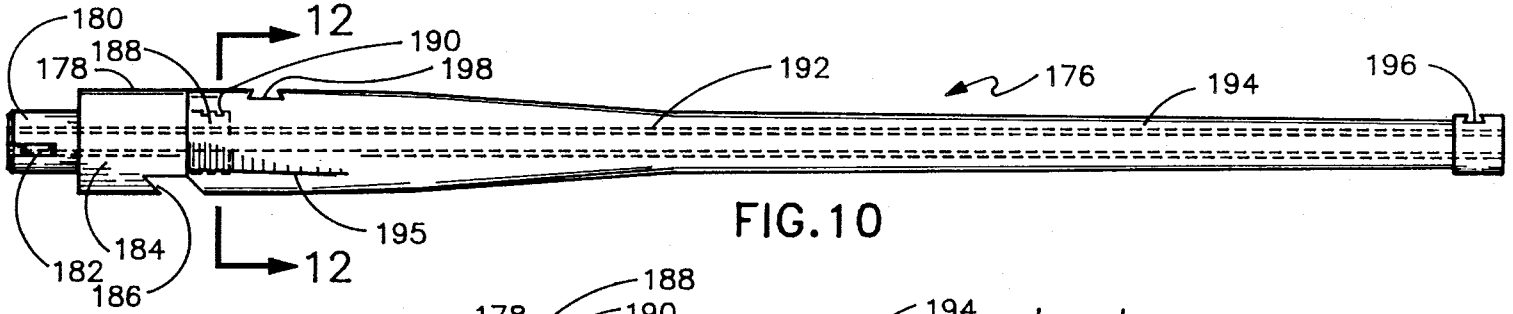
FIG. 10 illustrates the new barrel construction of the present invention.
Figure 11:
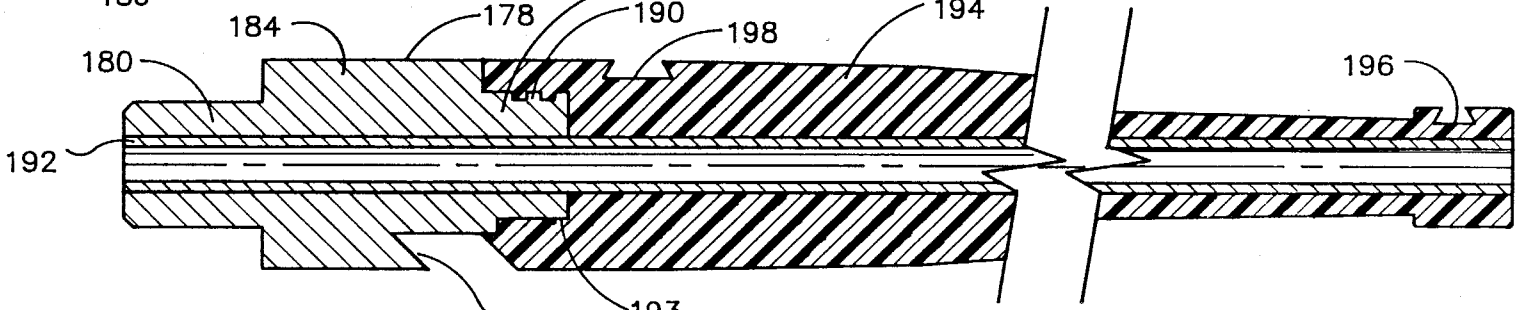
FIG. 11 is an enlarged, fragmentary, longitudinal cross-section showing in greater detail the parts of the barrel of FIG. 10.
Figure 12:
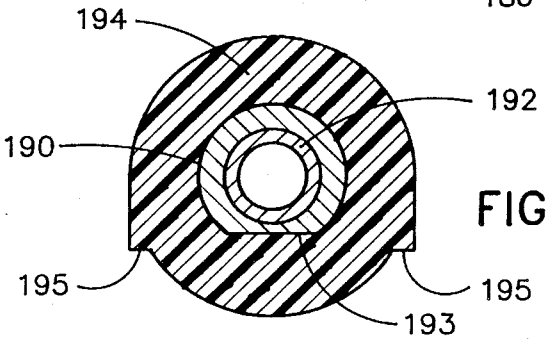
FIG. 12 is an enlarged, lateral cross-section, taken along lines 12—12 of FIG. 10.

A final rifle part of the present invention is a new barrel construction, which is illustrated in FIGS. 10–12. The barrel 176 shown in FIG. 10 can be substituted for the conventional rifle barrel 18 shown in FIG. 1. The rifle barrel 176 includes a barrel end member 178 having a reduced diameter end section 180, which is adapted to be received by a sleeve of a rifle chamber. The section 180 has a cutout portion or notch 182 for receiving an extractor slot held in the rifle chamber. The barrel end member 178 also has a center section 184 having a barrel notch 186 formed in a portion thereof. The barrel end member 178 additionally has a stem 188 formed at the other end of the barrel end member 178. The stem 186 is formed with serrations, or the like, 190 which extend outwardly from the surface of the stem 188. The barrel end member 178 is an integral piece and, therefore, the reduced diameter section 180, the center section 184, and the stem 188 are integrally formed together, preferably, of a metal material. In the preferred configuration, the length of the barrel end member 178 equals at least twice the total length of two bullet casings that can be fired from the rifle having the rifle barrel 176. The barrel 176 also includes an elongated insert or sleeve 192 which is received by a bore formed in the barrel end member 178. The insert 192 is substantially greater in length than the barrel end member 178 and extends for the entire length of the barrel 176. The insert 192 is made of a relatively strong metal and is preferably press fitted to the barrel end member 178 in order to interconnect these two parts together. The barrel 176 also includes a casing 194 that is located about the majority of the length of the metal insert 192 and extends from being located about the stem 188 to the end of the rifle barrel 176 opposite that of the reduced diameter section 180. The casing 194 is made of a much lighter material than the material which makes up the barrel end member 178 and the metal insert 192. In the preferred embodiment, the casing 194 is comprised of a plastic material. In forming the plastic casing, the barrel end member 178 and the metal insert 192 are supported in injection molding equipment that permits the injection molding of plastic to a desired diameter around portions of the metal sleeve 192 and the stem 188 of the barrel end member 178. As can be seen in FIG. 11, the plastic casing 194 terminates at the end of the center section 184 adjacent to the stem 188. The serrations 190 assist in maintaining a tight connection or attachment between the plastic casing 194 and the barrel end member 178. Additionally, as seen in FIGS. 11 and 12, the stem 188 has a flat 193 formed in a portion of the stem 188. The flat 193 is used to ensure that the barrel 176 does not rotate if the serrations 190 should fail to fixedly secure the plastic casing 194. In the embodiment shown, the casing 194 is formed with a pair of bosses 195. The bosses 195, preferably tapered, are used in improving the alignment and connection of the barrel to the rifle body as the bosses 195 are used to contact ridges provided on the channelled sections whereby possible rotation of the barrel 176 is further prevented and accurate barrel alignment is maintained. As can also be seen in FIG. 11, the preferred mold causes a free end slot 196 to be formed at the free end of the barrel 176, as well as a further lateral slot 198 that is located adjacent to the barrel end member 178.

The foregoing combination of rifle barrel parts including the materials from which the parts are made noticeably reduce the weight of the rifle barrel 176 over known barrel constructions. The metal barrel end member 178 and the metal insert 192 absorb or take up a substantial majority of the explosive force that occurs when a bullet is fired and exits the rifle through the rifle barrel 176. Because the plastic casing 194 is not subject to substantial or meaningful forces when the bullet is fired, the rifle barrel 176 maintains a long life while reducing the cost of the barrel in comparison with all-metal rifle barrels or other known rifle barrels being made of a composite material or a number of materials. It should also be understood that, although the barrel construction shown in FIGS. 10–12 is for use with a 22 caliber rifle, barrels for use in other rifles could be made utilizing the features of the barrel construction of the present invention.

Based on the foregoing detailed description, a number of worthwhile advantages of the present invention are immediately recognized. A number of various rifle parts are provided to facilitate the assembly/disassembly of a rifle and to make more easy the carrying of the rifle, as well as improve the appearance thereof. First, a handle unit can be added to a conventional rifle to permit the carrying thereof. Second, a front sight assembly is included to elevate the rifle sight while maintaining an accurate sight line. Third, a barrel retention assembly can be substituted for the conventional retaining device to reduce the assembly/disassembly time associated with the connection/removal of the rifle barrel from the body of the rifle. Fourth, an improved clamping device is available whereby a tool is not required to connect-/disconnect the rifle stock to the rifle. Lastly, a new rifle barrel construction is disclosed which includes a lighter material that reduces the weight of the rifle to be carried, as well as reducing the cost of making the rifle barrel.

Although the present invention has been described with reference to a plurality of embodiments, it should be appreciated that even further embodiments can be devised within the spirit and scope of this invention.

What is claimed is:

1. A method for use in making a relatively lighter rifle barrel, comprising:

providing a barrel end member having a bore;

providing a metal insert member having a length greater than the length of said barrel end member, wherein said barrel end member ans said metal insert member absorb a substantial majority of the explosive force that occurs when a bullet is fired from the rifle barrel;

connecting said insert member to said barrel end member; and injection molding a homogeneous plastic-like material only about said insert member, said plastic-like material being lighter than at least one of said barrel end member and said metal insert member and wherein said barrel end member, said insert member, and said plastic-like material comprise the rifle barrel.

2. A rifle barrel made of different materials, comprising:

a barrel end member adapted to be connected to portions of a rifle;

a metal insert member connected to said barrel end member and having a length greater than the length of said barrel end member, wherein said barrel end member and said metal insert member absorb a substantial majority of the explosive force that occurs when a bullet is fired from the rifle barrel; and a casing located about portions of said insert member, wherein said casing material consists essentially of a homogeneous plastic-like material lighter than at least one of said barrel end member and said metal insert member and with said-plastic-like material being provided by an injection molding process.

3. A rifle barrel made of different materials, comprising:

a barrel end member adapted to be connected to portions of a rifle, said barrel end member having a length equal to at least the total length of the casing of two bullets adapted to be fired from said rifle barrel;

a metal insert member connected to said barrel end member and having a length greater than the length of said barrel end member, wherein said barrel end member and said metal insert member absorb a substantial majority of the explosive force that occurs when a bullet is fired from the rifle barrel; and a casing located about portions of said insert member, wherein said casing material includes a plastic-like material lighter than at least one of said barrel end members and said metal insert member and with said plasticlike material being provided by an injection molding process.

4. A rifle barrel made of different materials, comprising:

a barrel end member adapted to be connected to portions of a rifle;

a metal insert member connected to said barrel end member and having a length greater than the length of said barrel end member, wherein said barrel end member and said metal insert member absorb a substantial majority of the explosive force that occurs when a bullet is fired from the rifle barrel;

a casing located about portions of said insert member, wherein said casing material includes a plastic-like material lighter than at least one of said barrel end member and said metal insert member and with said plastic like material being provided by an injection molding process;

wherein said barrel end member includes a stem having a discontinuous outer surface in which spaces are defined between portions of said outer surface and wherein said plastic-like material flows between said portions of said discontinuous outer surface during said injection molding process such that portions of said plastic-like material substantially fills the spaces between said portions of said discontinuous outer surface to facilitate the providing of a secure connection between said casing and said barrel end member.

* * * * *